United States Patent [19]

Miles

[11] 4,338,987

[45] Jul. 13, 1982

[54] TOOL BOX

[76] Inventor: Frank N. Miles, 2500 Franklin Blvd., Sacramento, Calif. 95818

[21] Appl. No.: 77,132

[22] Filed: Sep. 19, 1979

[51] Int. Cl.[3] ..... B27H 1/12

[52] U.S. Cl. ..... 144/285; 312/247; 312/306

[58] Field of Search ..... 312/247, 284, 306; 144/285

[56] References Cited

U.S. PATENT DOCUMENTS

| | | | |
|---|---|---|---|
| 398,391 | 2/1889 | Hammond | 144/285 |
| 477,509 | 6/1892 | Chase | 144/285 |
| 1,073,466 | 9/1913 | Birchler | 312/306 |
| 1,459,930 | 6/1923 | Riehle | 144/285 |
| 4,161,234 | 7/1979 | Munn | 312/306 |

*Primary Examiner*—W. D. Bray

*Attorney, Agent, or Firm*—Blair, Brown & Kreten

[57] ABSTRACT

Disclosed herein is a unique tool chest which combines the convenience of pegboard display with the mobility and security of a locking tool chest. A slideably disposed pegboard is contained within the tool chest and mounted on rails. A winch with a cable is located on the exterior of the tool chest and works in conjunction with the pegboard so that when the top lid of the tool chest is opened and the winch is cranked, the pegboard will extend upwardly out of the top of the tool chest and lock in the desired position. Thus easy access is provided to the tools hung upon pegs on either side of the pegboard. Doors located on the front and the rear of the tool chest allow access from either side. The entire tool chest sits upon a foundation piece provided with casters for easy mobility.

5 Claims, 10 Drawing Figures

FIG 1
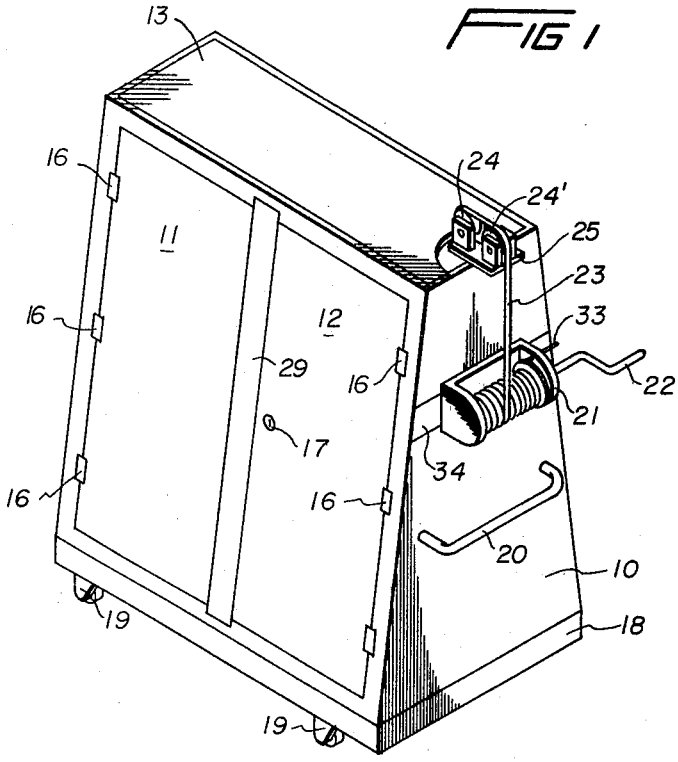
FIG 3
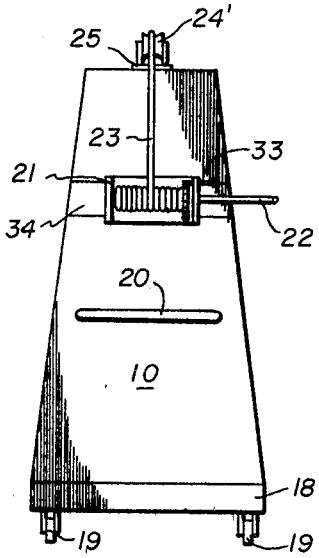
FIG 2
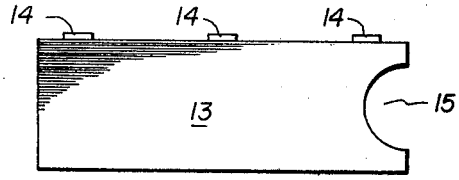
FIG 5
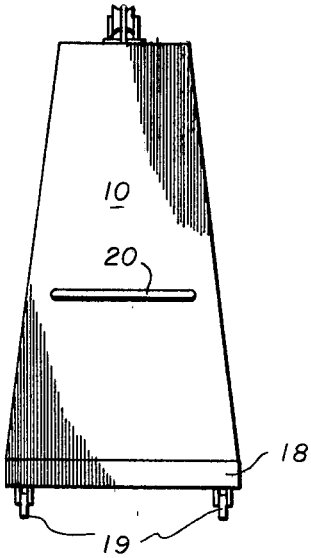
FIG 4
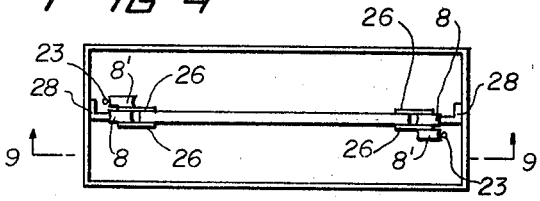
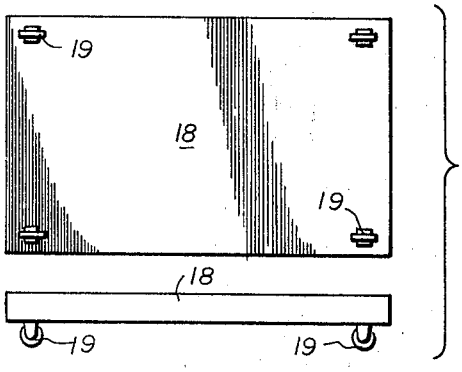
FIG 6

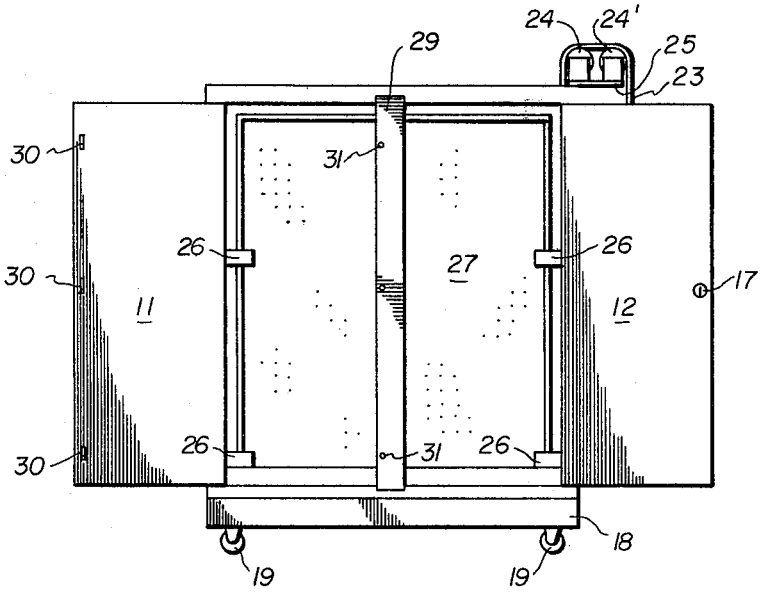
FIG 7
FIG 8
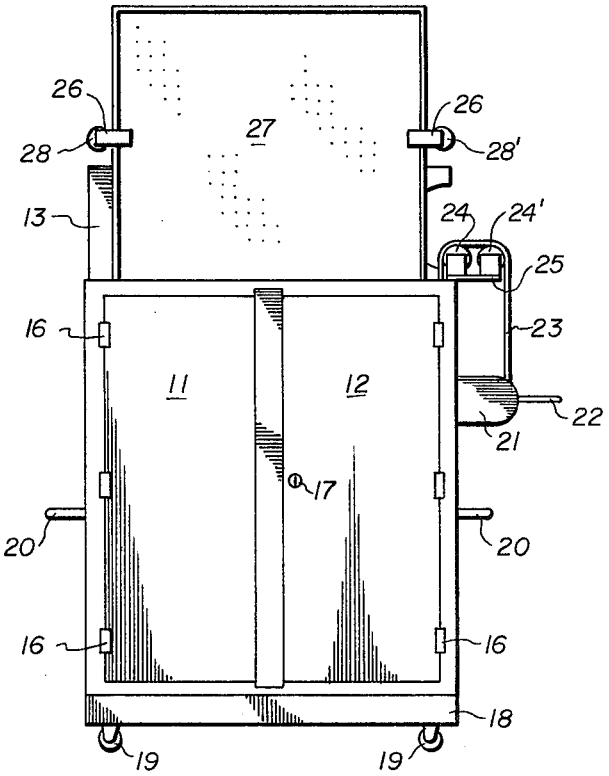

FIG 9
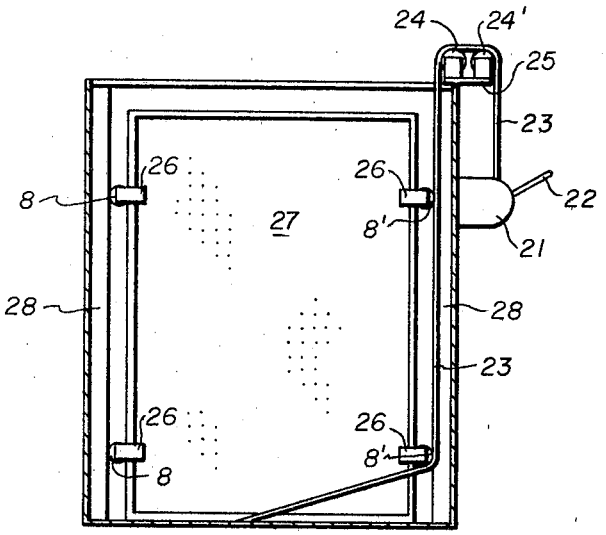
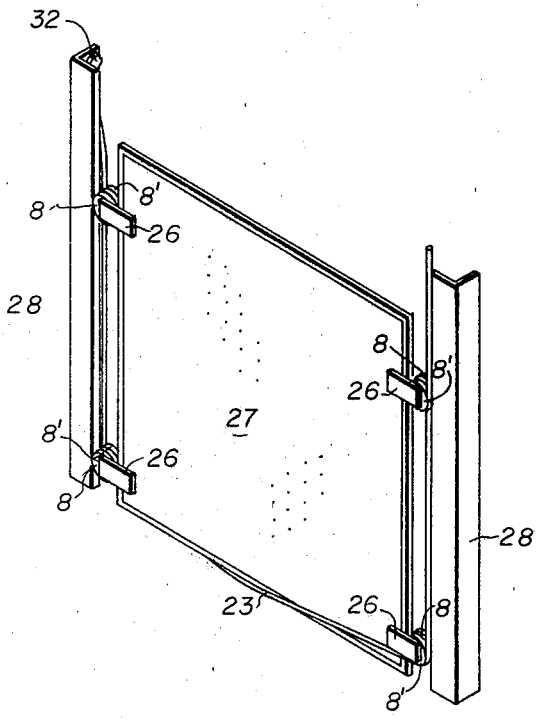
FIG 10

TOOL BOX

BACKGROUND OF THE INVENTION

A carpenter, a mechanic, or anyone who uses a large number of hand tools must have easy access to those tools while working, and be able to securely lock up the tools before leaving the job site. A certain portion of each day is spent on set-up, the process of arranging tools and materials in preparation for work, and break-down, the converse process. It is advantageous to reduce set-up and break-down time, because then more time can be spent doing the job and work efficiency is increased.

Many carpenters and mechanics utilize a pegboard mounted over their tool chest or work bench, upon which they hang tools, parts, and various paraphernalia, which provides them with a visual reference and easy access to the tools of their trade. However, the convenience of using a pegboard is somewhat vitiated because a pegboard is usually permanently installed somewhere and provides no way to lock up the materials hung thereon. Therefore, set-up and break-down time is increased when using a pegboard in conjunction with a tool chest, because the tools and sundry paraphernalia must be unlocked, mounted upon the pegboard piece by piece, and later returned to the locking tool chest at the end of the day's work. Thus a need exists to combine the convenience of the pegboard with the mobility and security of a locking tool chest.

The following U.S. Pat. No. references would appear to be germanee to the patentability of the present invention: 1,287,175 Anderson, 2,791,251 Steele, Jr. 1,459,930 Riehle, 3,118,685 Jordan.

Riehle teaches the use of a mobile tool rack, but it does not lock and is rather bulky.

Jordan teaches the use of a locking chest in conjunction with a pair of wheels and a push handle, but does not easily display the contents of the box and is a substantially different structure than that disclosed in the present invention.

Anderson teaches the use of locking tool chests provided on the top with lids that convert to work bench space. However, Anderson is not mobile, and is substantially different structurally from the present invention. Likewise, Steele teaches the use of a locking tool chest which has at least one opening space which converts to work bench space. Furthermore, Steele is provided with pegboard along certain interior faces of the unfolding tool chest. However, Steele is not provided wheels or casters, must be installed on top of a table or work bench, and does not contemplate extending the pegboard area beyond the confines of the chest itself.

Although coincidental similarities do exist between the prior art and the present invention, the present invention is distinguishable both structurally and conceptually.

SUMMARY AND OBJECTS OF THE INVENTION

Accordingly, it is a primary object of the present invention to combine the convenience of pegboard display with the mobility and security of a locking tool chest. This is accomplished in the present invention by providing a tool chest with an integral pegboard contained therein, which is extended from the confines of the tool chest by a winch located on the side of the tool chest and connected to the pegboard by a cable. Thus tools and other materials can be mounted on the pegboard and remain there, because the pegboard can be lowered within the confines of the tool chest and securely locked.

It is a further object of the present invention to utilize both sides of the pegboard thus doubling the display area. This is accomplished in the present invention by providing access doors on both the front and rear of the tool chest, and a pegboard that extends from the top of the tool chest so that both sides may be utilized.

It is a further object of the present invention to deploy the tool chest on a mobile base provided with casters.

Other objects and advantages will become apparent in the following specification when considered in light of the attached drawings.

BRIEF DESCRIPTION OF THE DRAWINGS

FIG. 1 is a perspective view of the tool chest.

FIG. 2 is a top view of the top lid of the tool chest.

FIG. 3 is an end view of the tool chest depicting the winch mechanism.

FIG. 4 is a top view of the tool chest without the lid showing the location of the pegboard.

FIG. 5 is an end view of the tool chest showing the opposing end from that of FIG. 3.

FIG. 6 shows a bottom view and a side view of the base piece of the tool chest.

FIG. 7 is a side view of the tool chest with the doors open.

FIG. 8 is a side view of the tool chest with the doors closed and the pegboard raised.

FIG. 9 is a partial side sectional view of the pegboard as it appears in the tool chest.

FIG. 10 is a perspective view of the mechanism that raises and lowers the pegboard.

DESCRIPTION OF THE PREFERRED EMBODIMENT

Referring now to the drawings in detail, wherein like reference characters indicate like parts throughout the several figures, reference numeral 10 refers generally to the body of the tool chest, which is in the shape of a truncated pyramid with a rectangular base. The tool chest is provided on the front and on the back with a pair of doors 11 and 12 disposed on hinges 16. The left-hand door is provided with a series of J-hooks 30 which engage hook eyes 31 located on the median support strip 29 of the tool chest body 10. This arrangement locks the left-hand door. The right-hand door is provided with a lock and key 17. The exact same configuration is used in both the front and rear doors. The top of the tool chest is provided with a lid 13 disposed on hinges 14 and having a cutaway 15 so that the lid may close without interfering with the cables 23 used to raise and lower the pegboard 27.

A winch 21, with a handle 22 and a locking pawl 33, is mounted to a mounting plate 34 on the side of the tool chest so that the cable 23 feeds off the spool of the wench in an upward direction. The cable 23 feeds over two sheaves 24 captured in a mounting bracket 25 which is located directly above the winch 21 and fastened to the outer extremity of the top surface of the tool chest. The cable then proceeds downwardly through the cutaway 15 into the interior of the tool chest. Inside the tool chest are two rails 28 vertically disposed along the extent of opposing ends of the chest.

The pegboard is disposed with a series of mounting brackets 26 located along opposing outer edges of the pegboard. Each mounting bracket 26 captures a pair of identical sheaves 24 mounted side by side so that one sheave aligns directly with the edge of the pegboard. This sheave coacts with and follows the rails 28. This configuration allows the pegboard to slide up and down as the sheaves track the rails 28. The other sheave in each pair guides the cable 23 as it descends along one edge of the pegboard, crossing underneath the bottom edge, ascends along the sheaves of the opposing edge, and terminates at a bolt 32 which fastens the end of the cable to the chest. The descending cable sheaves are off-set to one side of the pegboard, while the ascending cable sheaves are off-set to the opposite side of pegboard, so that the cable is forced to pass underneath the bottom edge of the pegboard as shown in FIG. 10.

In order to extend the pegboard, first, the top lid 13 is opened. Next, the winch is cranked which draws tension on the cable forcing the pegboard to slide upwardly along the rails. Because the cable is forced to pass underneath the bottom edge of the pegboard, the board itself can be fully extended, and when the pegboard reaches the desired height it can be locked in that position by the locking pawl 33 located on the winch.

The entire tool chest sits upon a base piece 18 provided with casters 19 so that the entire tool chest can be easily moved and deployed where needed. Handles 20 are provided on opposing ends of the tool chest to facilitate moving it along.

Having thus described the preferred embodiment of the invention it should be understood that numerous structural modifications and adaptations may be restored to without departing from the spirit of the invention.

What is claimed is:

1. A tool chest for storing tools and the like comprising, in combination, an enclosure having a pair of end walls and a pair of side walls defining an interior and an open upper end, a closure pivotally movable into closing relationship with said open upper end, a substantially planar peg board having a front surface and a rear surface for supporting a plurality of tools on both of said surfaces disposed within said enclosure interior intermediate said side walls in a substantially vertical plane, each of said side walls being provided with at least one access opening for access to said board within said enclosure, a latchable door on each of said side walls closing said at least one access opening, guide means on said enclosure for slidably retaining said board for vertical movement in said vertical plane through said open upper end between a retracted position within said enclosure and an extended position above said open upper end for exposing said board front and rear surfaces to permit access through said at least one access opening in said side walls to said plurality of tools supported on said surfaces and means accessible from the exterior of said enclosure for moving said board into a selected vertical position between said retracted position and said extended position wherein said guide means comprises a vertically extending rail mounted on the inner surface of each of said end walls and roller means on each of the side edges of said board for sliding engagement with the respective one of said rails for said sliding movement of said board.

2. A tool chest in accordance with claim 1 wherein a pair of access openings are provided in each of said side walls and wherein each of said pair of access openings are provided with a latchable door.

3. A tool chest in accordance with claim 2 wherein said board moving means comprises a winch having a handle mounted on the outer surface of said enclosure, a cable attached at one end to said winch and extending downwardly into said enclosure through said open upper end along one side of said board, across the lower edge of said board and upwardly along the other side edge of said board and means for securing the other end of said cable to said enclosure wherein said board is lifted and lowered by the portion of said cable extending across the lower edge of said board during the operation of said winch.

4. The device of claim 3 wherein said enclosure is supported on casters and handles are provided on said enclosure for towing.

5. The device of claim 4 wherein said enclosure has a truncated pyramid configuration.

* * * * *